US005679427A

United States Patent [19]

Instance

[11] Patent Number: 5,679,427

[45] **Date of Patent: *Oct. 21, 1997**

[54] LABELS AND MANUFACTURE THEREOF

[76] Inventor: David John Instance, Guinea Hall, Sellindge, Kent TN25 6EG, United Kingdom

[ * ] Notice: The term of this patent shall not extend beyond the expiration date of Pat. No. 5,399,403.

[21] Appl. No.: 285,435

[22] Filed: Aug. 4, 1994

Related U.S. Application Data

[63] Continuation of Ser. No. 974,596, Feb. 26, 1993, Pat. No. 5,399,403.

[30] Foreign Application Priority Data

Aug. 31, 1990 [GB] United Kingdom ..... 9019032

[51] Int. Cl.[6] ..... B31D 1/02; G09F 3/02

[52] U.S. Cl. ..... 428/40.1; 156/253; 156/267; 156/268; 156/269; 156/270; 156/277; 156/290; 156/291; 156/299; 156/300; 156/301; 156/303; 281/2; 281/5; 428/41.7; 428/41.8; 428/77; 428/124; 428/126; 428/130; 428/192; 428/194

[58] Field of Search ..... 428/40, 77, 41, 428/124, 126, 42, 130, 192, 194, 195, 40.1, 41.7, 41.8, 41.9; 283/81; 281/2, 5; 156/277, 253, 268, 270, 267, 269, 290, 291, 299–301, 303

[56] References Cited

U.S. PATENT DOCUMENTS

| | | | |
|---|---|---|---|
| 2,246,984 | 6/1941 | Palmer | 40/2 |
| 4,285,999 | 8/1981 | Olivieri et al. | 428/42.1 |
| 4,744,591 | 5/1988 | Instance | 281/5 |
| 4,991,878 | 2/1991 | Cowan | 283/81 |

FOREIGN PATENT DOCUMENTS

| | | |
|---|---|---|
| 0130053 | 1/1985 | European Pat. Off. . |
| 0140420 | 5/1985 | European Pat. Off. . |
| 0161914 | 11/1985 | European Pat. Off. . |
| 0180365 | 5/1986 | European Pat. Off. . |
| 0192444 | 8/1986 | European Pat. Off. . |
| 0195427 | 9/1986 | European Pat. Off. . |
| 0098092 | 12/1986 | European Pat. Off. . |
| 0232054 | 8/1987 | European Pat. Off. . |
| 0283064 | 9/1988 | European Pat. Off. . |
| 0304242 | 2/1989 | European Pat. Off. . |
| 0306125 | 3/1989 | European Pat. Off. . |
| 2133343 | 7/1984 | United Kingdom . |
| 2166109 | 4/1986 | United Kingdom . |
| 2199010 | 6/1988 | United Kingdom . |
| 89 05021 | 6/1989 | WIPO . |
| 90 02395 | 3/1990 | WIPO . |
| 90 05631 | 5/1990 | WIPO . |
| 91 04850 | 4/1991 | WIPO . |
| 91 04851 | 4/1991 | WIPO . |

OTHER PUBLICATIONS

"Examiner's report to the Comptroller under Section 17 (The Search Report)" dated 18 Oct. 1990 (search report issued on UK Appln. 9019032.3).

"International Search Report" dated 11 Dec. 1991 (EPO search report issued on International Appln. PCT/GB 91/01471).

*Primary Examiner*—Nasser Ahmad

*Attorney, Agent, or Firm*—Rothwell, Figg, Ernst & Kurz, P.C.

[57] ABSTRACT

A self-adhesive label comprising a multilaminar label portion, a self-adhesive laminar material extending over, and adhered by its self-adhesive surface to, the multilaminar label portion thereby to form two self-adhesive edge portions thereof on opposed sides of the multilaminar label portion, a backing of release material to which one of the edge portions is releasably adhered and an unadhesive portion which is located on the rear surface of the said one edge portion.

15 Claims, 1 Drawing Sheet

LABELS AND MANUFACTURE THEREOF

This is a continuation of application Ser. No. 07/974,596, filed Feb. 26, 1993, now U.S. Pat. 5,399,403.

BACKGROUND OF THE INVENTION

The present invention relates to a self-adhesive label and to a method of producing a succession of self-adhesive labels carried on a backing of release material.

A number of self-adhesive multilaminar labels are known. These labels can suffer from the disadvantage that they can be difficult for a user to open when the self-adhesive label is adhered to a product.

SUMMARY OF THE INVENTION

The present invention aims to provide a convenient and elegant solution to this problem.

Accordingly, the present invention provides a self-adhesive label comprising a multilaminar label portion, a self-adhesive laminar material extending over, and adhered by its self-adhesive surface to, the multilaminar label portion thereby to form two self-adhesive edge portions thereof on opposed sides of the multilaminar label portion, a backing of release material to which one of the edge portions is releasably adhered by a self-adhesive rear surface thereof and an unadhesive portion which is located on the rear surface of the said one edge portion.

The present invention also provides a method of producing a succession of self-adhesive labels carried on a backing of release material, the method comprising the steps of:

(a) releasably adhering a succession of multilaminar label portions to a backing of release material;

(b) either before, during or after step (a) applying a succession of patches of non-adhesive material to the backing of release material, (c) applying a self-adhesive laminar material over the succession of multilaminar label portions and patches on the backing of release material, the laminar material being adhered thereto by the self-adhesive surface thereof; and (d) cutting through the laminar material and the multilaminar label portions thereby to form the self-adhesive labels, each self-adhesive label including an edge portion of the laminar material having a respective one of the said patches which is unadhered to the backing of release material.

BRIEF DESCRIPTION OF THE DRAWINGS

An embodiment of the present invention will now be described by way of example only with reference to the accompanying drawings, in which.

DESCRIPTION OF THE PREFERRED EMBODIMENT

Figure 1:
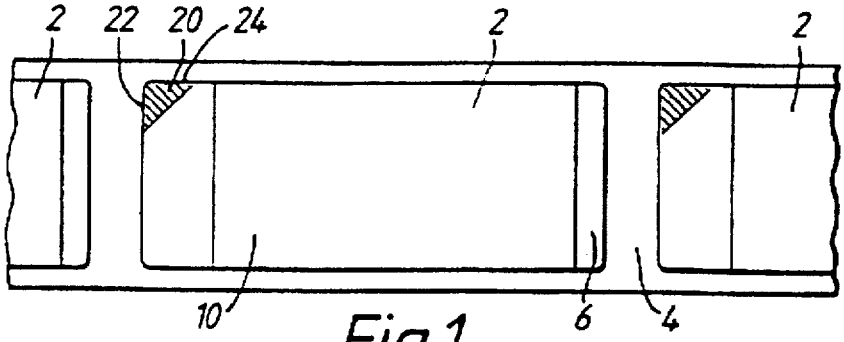
FIG. 1 is a plan view of a succession of labels in accordance with a first embodiment of the present invention when carried on the backing of release material.
Figure 2:
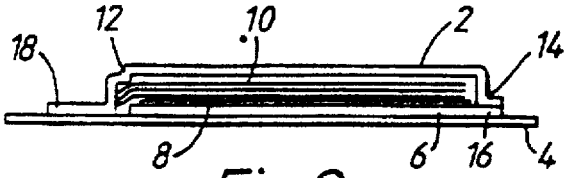
FIG. 2 is an elevational view of a label of FIG. 1 when carried on a backing of release material.

Referring to FIG. 1, there is shown a succession of self-adhesive labels 2 in accordance with a first embodiment of the present invention when carried on a backing 4 of release material. As is shown more clearly with reference to FIG. 2, each label 2 comprises a support piece 6 which is self-adhesive, the support piece being coated on its rear surface with a layer of pressure-sensitive adhesive which is releasably carried on the backing 4 of release material. A major portion, apart from a transverse edge, of the upper surface of the support piece 6 is coated with a layer 8 of adhesive, such as a water-soluble or hot melt adhesive, and the layer 8 of adhesive adheres to the support piece 6 a multilaminar label 10, such as a booklet. The layer 8 may be applied as extruded beads or as a whole surface coat. A self adhesive laminar material 12, such as a clear plastics material, has a self-adhesive rear surface and the laminar material 12 is adhered by its self-adhesive surface over the support piece 6 and the label 10 thereby to constitute the entire front surface of the label 2. A portion 14 of the laminar material 12 is adhered to the transverse edge 16 of the support piece 6 which is not covered by the label 10. At the other transverse edge of the label 2 the laminar material 12 includes an edge portion 18 which is adhered by its self-adhesive surface directly to the backing 4 of release material. Referring again to FIG. 1, a corner of the edge portion 18 of the laminar material 12 is coated on its rearwardly-directed self-adhesive surface with a patch of ink 20. The patch of ink 20 extends as far as the free edge 22 of the laminar 12 and acts to define an unadhered flap 24 which is not self-adhesive.

In use, the label 2 is removed from the backing 4 of release material and adhered to a product by the self-adhesive rear surface of the support piece 6 and the self-adhesive surface of the edge portion 18 of the laminar material 12. When it is desired to open the multilaminar label 10, a user manually pulls the unadhered flap 24 to release the edge portion 18 from the product.

The provision of a patch of ink on the rearwardly directed surface of the edge portion is a neat and convenient solution to enable a user readily to identify which portion of the label requires pulling in order to be able to open the label and also provides a flap which is unadhered to the product.

Figure 3:
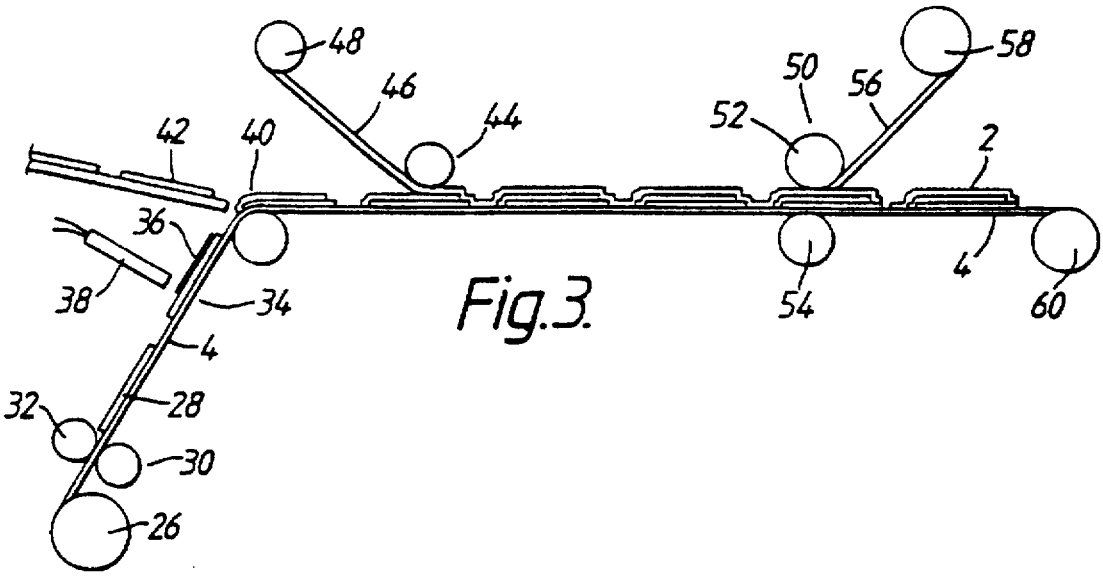
FIG. 3 schematically illustrates a method of manufacturing the labels of FIG. 1.

Referring to FIG. 3 there is shown schematically an apparatus for using a method for making labels in accordance with the first embodiment of the present invention. There is provided a reel 26 of a backing 4 of release material carrying thereon a succession of die-cut support pieces 28. The backing 4 of release material with the support pieces 28 releasably adhere thereon is passed to an ink applying station 30 at which patches of ink 20 are successively applied to the upper surface of the backing 4 of release material. The printing station 30 may typically comprise printing rollers 32. The web then passes to an adhesive applying station 34 at which an adhesive layer 36 is applied to the upper surface of the support pieces 28 by an adhesive applicator 38. The web then passes to a label applying station 40 at which a succession of labels 42 is applied to a respective succession of adhesive layers 36 and then the composite assembly is passed to a laminar material applying station 44 at which a web of self-adhesive laminar material 46 is fed out from a reel 48 thereof and applied over the top of the assembly. The combined assembly then passes to a die-cutting station 50 comprising a die-cutting roller 52 and a backing roller 54. At the die-cutting station 50, the die-cutting roller 52 cuts through the laminar material 46, the applied labels 42 and the support pieces 28 thereby to cut out the resultant labels 2 shown in FIGS. 1 and 2 and the waste web remnant 56 is removed and taken up on a reel 58. The labels 2 carried on the backing 4 of release material are then taken up on a storage reel 60.

Figure 4:
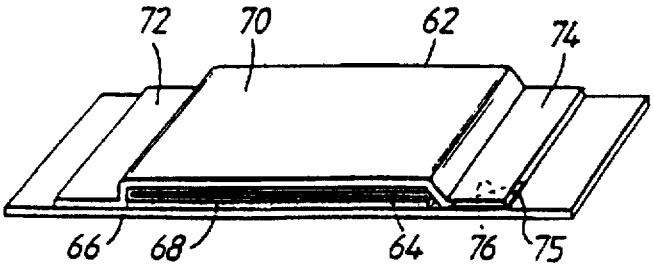
FIG. 4 is a perspective plan view of a label in accordance with a second embodiment of the present invention.

A further embodiment of a label in accordance with the present invention is illustrated in FIG. 4. In this embodiment, the support piece is omitted. The self-adhesive label 62 comprises a multilaminar label 64 which is adhered directly to a backing 66 of release material by a layer 68 of pressure-sensitive adhesive. The layer 68 of pressure-sensitive adhesive may be either in the form of extruded beads or as a whole surface coating. A self-adhesive laminar material 70 extends over both transverse edges of the multilaminar label 64 and the laminar material 70 is adhered by its self-adhesive rearwardly directed surface at two opposed edge portions 72, 74 thereof to the backing 66 of release material. A corner flap portion 75 of the rearwardly directed surface of the edge portion 74 is coated with a patch of ink 76 which renders the patch non-adhesive. When the self-adhesive label 62 is adhered to a product, the body of the label is adhered to the product by the adhesive layer 68 and the edges of the label 62 are adhered to the product by the edge portions 72, 74. The edge portion 74 can readily be pulled away from the product by manual grabbing of the corner flap portion 75 which is formed by the patch of ink 76.

I claim:

1. A self-adhesive label comprising:

a self-adhesive support piece which is carried on a backing of release material;

a multilaminar label portion, separate from the support piece, which is disposed on the support piece; and a self-adhesive laminar material extending over, and adhered by its self-adhesive surface to, the multilaminar label portion, thereby to form two self-adhesive edge portions thereof on opposed sides of the multilaminar label portion, one of the edge portions being releasably adhered to the backing of release material and the edge portion other than the said one edge portion being adhered to a surface of the support piece.

2. A self-adhesive label according to claim 1 wherein the multilaminar label portion is a booklet.

3. A self-adhesive label according to claim 1 wherein the multilaminar label portion is adhered to the support piece.

4. A self-adhesive label according to claim 1 wherein the said one edge portion has an unadhered flap.

5. A method of producing a succession of self-adhesive labels carried on a backing of release material, the method comprising the steps of:

(a) providing a succession of self-adhesive die-cut support pieces on a release backing material;

(b) applying a succession of multilaminar label portions to the succession of support pieces;

(c) applying a self-adhesive laminar material over the succession of multilaminar label portions and support pieces and the backing of release material, the laminar material being adhered thereto by the self-adhesive surface thereof; and (d) cutting through the laminar material, the multilaminar label portions and the support pieces thereby to form the self-adhesive labels, each self-adhesive label including, on opposed sides to a respective one of the multilaminar label portions, first and second edge portions of the laminar material which are respectively adhered to the backing of release material and to a respective support piece.

6. A method according to claim 5 wherein the multilaminar label portions comprise booklets.

7. A method according to claim 5 wherein the multilaminar label portions are adhered to the succession of support pieces.

8. A method according to claim 5 wherein the self-adhesive label includes an unadhered flap which may be pulled to release the said first portion thereby to open the multilaminar label portions.

9. A self-adhesive label comprising:

a bottom support piece having a self-adhesive rear surface;

an intermediate booklet separate from the support piece and disposed on an upper surface of the support piece; and a top self-adhesive laminar material having a self-adhesive rear surface which is adhered to the booklet and to the support piece along one edge of the booklet, the laminar material including an edge portion along an opposed edge of the booklet whereby the rear self-adhesive surface of the label comprises the support piece and the said edge portion of the laminar material.

10. A self-adhesive label according to claim 9 wherein the booklet is adhered to the support piece.

11. A self-adhesive label comprising:

a multilaminar label portion;

a self-adhesive support piece which is carried on a backing of release material and on which the multilaminar label portion is disposed;

a self-adhesive laminar material extending over, and adhered by its self-adhesive surface to, the multilaminar label portion thereby to form two self-adhesive edge portions thereof on opposed sides of the multilaminar label portion, one of the edge portions being releasably adhered by a self-adhesive rear surface thereof to the backing of release material and the edge portion other than the said one edge portion being adhered to a surface of the support piece and the label having an unadhered flap of the said one edge portion which may be pulled to release the said one edge portion thereby to open the multilaminar label portion.

12. A self-adhesive label according to claim 11 wherein the multilaminar label portion is a booklet.

13. A self-adhesive label according to claim 11 wherein the multilaminar label portion is adhered to the support piece.

14. A self-adhesive label comprising:

a bottom support piece having a self-adhesive rear surface;

an intermediate booklet disposed on an upper surface of the support piece; and a top self-adhesive laminar material having a self-adhesive rear surface which is adhered to the booklet and to the support piece along one edge of the booklet, the laminar material including an edge portion along an opposed edge of the booklet whereby the rear self-adhesive surface of the label comprises the support piece and the said edge portion of the laminar material, and an unadhered flap of the edge portion whereby when the label is adhered to a product, the unadhered flap may be pulled to release the said edge portion thereby to open the booklet.

15. A self-adhesive label according to claim 14 wherein the booklet is adhered to the support piece.

* * * * *